US008161948B2

(12) United States Patent
Grunwald et al.

(10) Patent No.: US 8,161,948 B2
(45) Date of Patent: Apr. 24, 2012

(54) METHOD FOR TESTING THE FUNCTION OF A PRESSURE SWITCH OF A TANK VENTILATION SYSTEM, CONTROL DEVICE, AND INTERNAL COMBUSTION ENGINE

(75) Inventors: Oliver Grunwald, Ingolstadt (DE); Armin Köhler, Ingolstadt (DE)

(73) Assignees: Continental Automotive GmbH, Hannover (DE); Audi Aktiengesellschaft, Ingolstadt (DE)

( * ) Notice: Subject to any disclaimer, the term of this patent is extended or adjusted under 35 U.S.C. 154(b) by 313 days.

(21) Appl. No.: 12/516,775

(22) PCT Filed: Nov. 27, 2007

(86) PCT No.: PCT/EP2007/062869

§ 371 (c)(1),
(2), (4) Date: May 28, 2009

(87) PCT Pub. No.: WO2008/065103

PCT Pub. Date: Jun. 5, 2008

(65) Prior Publication Data

US 2010/0071672 A1 Mar. 25, 2010

(30) Foreign Application Priority Data

Nov. 29, 2006 (DE) ..... 10 2006 056 384

(51) Int. Cl.
*F02M 33/02* (2006.01)
*F02M 25/08* (2006.01)
*F02B 77/08* (2006.01)

(52) U.S. Cl. ..... 123/516; 123/520; 123/198 D; 73/114.39

(58) Field of Classification Search ..... 123/516, 123/518, 519, 520, 198 D; 73/114.38, 114.39
See application file for complete search history.

(56) References Cited

U.S. PATENT DOCUMENTS

| | | | | |
|---|---|---|---|---|
| 5,146,902 | A | 9/1992 | Busato et al. | |
| 5,263,462 | A | 11/1993 | Reddy | |
| 5,353,644 | A | 10/1994 | Frank et al. | |
| 5,398,661 | A | 3/1995 | Denz et al. | |
| 5,572,981 | A | 11/1996 | Pfleger et al. | |
| 5,987,968 | A * | 11/1999 | Cook et al. | 73/49.7 |
| 6,016,691 | A | 1/2000 | Cook et al. | |
| 6,082,189 | A | 7/2000 | Bayerle et al. | |
| 6,260,410 | B1 * | 7/2001 | Cook et al. | 73/114.39 |

(Continued)

FOREIGN PATENT DOCUMENTS

DE 4132055 A1 4/1993

(Continued)

*Primary Examiner* — Thomas Moulis
(74) *Attorney, Agent, or Firm* — King & Spalding L.L.P.

(57) ABSTRACT

The switched state of a pressure switch in a tank ventilation system of a motor vehicle is used for testing the function of the tank ventilation system, the pressure switch being in a low-pressure position if the pressure in the tank ventilation system is lower than a predefined pressure limit while being in a high-pressure position if that is not the case. A defective pressure switch can result in wrong assessments. Disclosed is a method for testing the function of the pressure switch, the method encompassing the following steps: a switched state of the pressure switch is detected; a measure is carried out that increases the pressure in the tank ventilation system above the pressure limit if the pressure switch is in the low-pressure position; a defect of the pressure switch is identified if the pressure switch remains in the low-pressure position after carrying out the measure.

24 Claims, 4 Drawing Sheets

U.S. PATENT DOCUMENTS

| | | | | |
|---|---|---|---|---|
| 6,301,955 | B1 * | 10/2001 | Cook et al. | 73/49.7 |
| 6,343,505 | B1 * | 2/2002 | Cook et al. | 73/114.39 |
| 6,508,235 | B2 | 1/2003 | Fabre | |
| 6,626,032 | B2 * | 9/2003 | Fabre et al. | 73/114.39 |
| 6,722,189 | B2 * | 4/2004 | Fabre | 73/114.39 |
| 6,782,873 | B2 * | 8/2004 | Streib | 123/520 |
| 2001/0032625 | A1 | 10/2001 | Fabre | |
| 2003/0000289 | A1 | 1/2003 | Weldon | |
| 2009/0211348 | A1 * | 8/2009 | Meixner | 73/114.38 |
| 2010/0101541 | A1 * | 4/2010 | Grunwald et al. | 123/518 |
| 2011/0079298 | A1 * | 4/2011 | Eser | 137/488 |

FOREIGN PATENT DOCUMENTS

| | | | |
|---|---|---|---|
| DE | 4229487 | A1 | 3/1994 |
| DE | 4427688 | A1 | 2/1996 |
| DE | 19713085 | A1 | 10/1998 |
| DE | 10209432 | A1 | 9/2003 |
| DE | 60115850 | T2 | 7/2006 |

* cited by examiner

METHOD FOR TESTING THE FUNCTION OF A PRESSURE SWITCH OF A TANK VENTILATION SYSTEM, CONTROL DEVICE, AND INTERNAL COMBUSTION ENGINE

CROSS-REFERENCE TO RELATED APPLICATIONS

This application is a United States national phase filing under 35 U.S.C. §371 of International Application No. PCT/EP2007/062869, filed Nov. 27, 2007 which claims priority to German Patent Application No. 10 2006 056 384.0, filed Nov. 29, 2006. The complete disclosure of the above-identified application is hereby fully incorporated herein by reference.

TECHNICAL FIELD

The invention relates to a method for testing the function of a pressure switch of a tank ventilation system for an internal combustion engine of a motor vehicle, a control device which is embodied such that it can carry out the method, and an internal combustion engine which comprises such a control device.

BACKGROUND

In order to comply with ever stricter emissions limits, it is necessary in automotive technology reliably to identify defects in a tank ventilation system of a motor vehicle. This prevents fuel vapors from escaping unnoticed from the tank ventilation system.

A method for detecting a leak in a tank ventilation system is known from patent specification U.S. Pat. No. 5,263,462. The method takes advantage of the natural formation of a vacuum inside the tank ventilation system after the vehicle has been switched off. According to the method, after the motor vehicle has been switched off, the reduction in the coolant temperature is monitored. If the coolant temperature falls below a specified value, a check is made as to whether a pressure switch arranged in the tank ventilation system has closed. Closure of the pressure switch indicates a reduction of the pressure inside the tank ventilation system below a predefined pressure value. When the pressure switch is closed, a leak inside the tank ventilation system can be ruled out since a natural vacuum has been able to form inside the tank ventilation system as a result of the cooling. An open pressure switch on the other hand is assessed as being an indication of a leak inside the tank ventilation system. In the case of a defective pressure switch, however, incorrect diagnoses can emerge. For example, in the event of the pressure switch clamping in the closed state, a leak in the tank ventilation system cannot be identified.

SUMMARY

According to various embodiments a method for testing the function of a pressure switch of a tank ventilation system, and a control device and an internal combustion engine can be provided which are characterized by improved reliability in the testing of the function of the tank ventilation system.

According to an embodiment, a method for testing the function of a pressure switch of a tank ventilation system for an internal combustion engine of a motor vehicle, the pressure switch being in a low-pressure position if the pressure in the tank ventilation system is lower than a predefined pressure limit, and the pressure switch being in a high-pressure position if that is not the case, wherein the method comprises the following steps: detecting a switched state of the pressure switch, carrying out a measure that increases the pressure in the tank ventilation system above the pressure limit if the pressure switch is in the low-pressure position, identifying a defect of the pressure switch if the pressure switch remains in the low-pressure position after the measure has been carried out.

According to a further embodiment, the measure may comprise: when the internal combustion engine is at a standstill, a tank ventilation valve of the tank ventilation system, which valve is arranged in a connecting line between a fuel vapor accumulator and an intake pipe of the internal combustion engine, is actuated such that the tank ventilation system is pneumatically connected to the intake pipe. According to a further embodiment, the tank ventilation valve can be actuated such that the tank ventilation system and the intake pipe are pneumatically separated once the pressure switch switches to the high-pressure position after the measure has been carried out. According to a further embodiment, the measure may comprise: when the internal combustion engine is in operation, a tank ventilation valve of the tank ventilation system, which valve is arranged in a connecting line between a fuel vapor accumulator and an intake pipe of the internal combustion engine, is actuated such that the tank ventilation system and the intake pipe are pneumatically separated. According to a further embodiment, the acceleration of the motor vehicle may be detected, and the defect of the pressure switch is identified, if the acceleration exceeds a predefined acceleration limit. According to a further embodiment, the defect of the pressure switch can be identified only when the acceleration exceeds the predefined acceleration limit several times. According to a further embodiment, both the longitudinal acceleration and the lateral acceleration of the motor vehicle can be detected. According to a further embodiment, a temperature that represents a measure of the temperature in the tank ventilation system can be detected, and a defect of the pressure switch can be identified, if the temperature exceeds a predefined temperature limit. According to a further embodiment, the temperature concerned may be the coolant temperature of the internal combustion engine. According to a further embodiment, the temperature concerned may be the temperature in a fuel tank of the motor vehicle. According to a further embodiment, the temperature concerned may be the ambient temperature of the motor vehicle.

According to a further embodiment, the temperature concerned may be the exhaust gas temperature of the motor vehicle. According to a further embodiment, the time period from implementation of the measure can be detected, and a defect of the pressure switch is identified, only when the time period exceeds a predefined time-period limit. According to a further embodiment, prior to identification of a defect of the pressure switch, testing of the function of the tank ventilation valve can be carried out and the defect of the pressure switch can be identified only when the testing of the function of the tank ventilation valve reveals that the tank ventilation valve does not clamp in a state in which the tank ventilation system is pneumatically separated from the intake pipe. According to a further embodiment, prior to identification of a defect of the pressure switch, testing of the function of the tank ventilation valve can be carried out and the defect of the pressure switch can be identified only when the testing of the function of the tank ventilation valve reveals that the tank ventilation valve does not clamp in a state in which the tank ventilation system is pneumatically connected to the intake pipe.

According to another embodiment, a control device may be provided for a motor vehicle which comprises a tank ventilation system, the tank ventilation system having a pressure switch that is in a low-pressure position if the pressure in the tank ventilation system is lower than a predefined pressure limit, and the pressure switch being in a high-pressure position if that is not the case, wherein the control device for testing the function of the pressure switch is operable: to detect a switched state of the pressure switch, to carry out a measure that increases the pressure in the tank ventilation system above the pressure limit if the pressure switch is in the low-pressure position, and to identify a defect of the pressure switch if the pressure switch remains in the low-pressure position after the measure has been carried out.

According to a further embodiment, the measure may comprise: when an internal combustion engine of the motor vehicle is at a standstill, a tank ventilation valve of the tank ventilation system, which valve is arranged in a connecting line between a fuel vapor accumulator and an intake pipe of the internal combustion engine, is actuated such that the tank ventilation system is pneumatically connected to the intake pipe. According to a further embodiment, the measure may comprise: when an internal combustion engine of the motor vehicle is in operation, a tank ventilation valve of the tank ventilation system, which valve is arranged in a connecting line between a fuel vapor accumulator and an intake pipe of the internal combustion engine, is actuated such that the tank ventilation system and the intake pipe are pneumatically separated. According to a further embodiment, the acceleration of the motor vehicle may be detected, and the defect of the pressure switch may be identified, when the acceleration exceeds a predefined acceleration limit. According to a further embodiment, the defect of the pressure switch can be identified only when the acceleration exceeds the predefined acceleration limit several times. According to a further embodiment, both the longitudinal acceleration and the lateral acceleration of the motor vehicle can be detected. According to a further embodiment, a temperature can be detected which represents a measure of the temperature in the tank ventilation system, and a defect of the pressure switch is identified, if the temperature exceeds a predefined temperature limit. According to a further embodiment, the temperature concerned can be the coolant temperature of the internal combustion engine. According to a further embodiment, the temperature concerned can be the temperature in a fuel tank of the motor vehicle. According to a further embodiment, the temperature concerned can be the ambient temperature of the motor vehicle. According to a further embodiment, the temperature concerned can be the exhaust gas temperature of the motor vehicle. According to a further embodiment, the time period from implementation of the measure can be detected, and a defect of the pressure switch can be identified only when the time period exceeds a predefined time-period limit. According to a further embodiment, prior to identification of a defect of the pressure switch, testing of the function of the tank ventilation valve may be carried out, and the defect of the pressure switch may be identified, only if the testing of the function of the tank ventilation valve reveals that the tank ventilation valve does not clamp in a state in which the tank ventilation system is pneumatically separated from the intake pipe. According to a further embodiment, prior to identification of a defect of the pressure switch, testing of the function of the tank ventilation valve can be carried out, and the defect of the pressure switch can be identified, only if the testing of the function of the tank ventilation valve reveals that the tank ventilation valve does not clamp in a state in which the tank ventilation system is pneumatically connected to the intake pipe.

According to another embodiment, an internal combustion engine may comprise a control device as described above.

BRIEF DESCRIPTION OF THE DRAWINGS

An exemplary embodiment of the present invention will be illustrated in detail below with reference to the enclosed drawings, in which.

DETAILED DESCRIPTION

Figure 1:
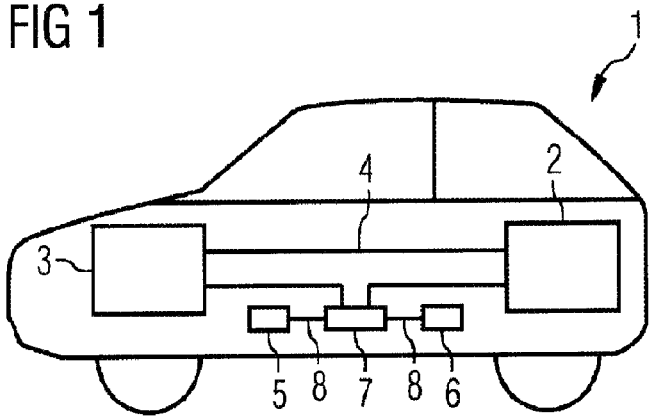
FIG. 1 shows a schematic representation of a motor vehicle comprising an internal combustion engine and a tank ventilation system.

The method according to an embodiment serves in testing the function of a pressure switch of a tank ventilation system for an internal combustion engine of a motor vehicle. The pressure switch is in a low-pressure position if the pressure in the tank ventilation system is lower than a predefined pressure limit, and is in a high-pressure position if that is not the case. According to the method, firstly, a switched state of the pressure switch is detected. If it is identified that the pressure switch is in the low-pressure position, a measure is carried out that increases the pressure in the tank ventilation system above the pressure limit. If the pressure switch remains in the low-pressure position even after the measure has been carried out, a defect of the pressure switch is identified.

The method according to various embodiments permits reliable testing of whether the pressure switch is clamping in the low-pressure position. Identification of such a defect of the pressure switch means that incorrect diagnoses of the tank ventilation system can be prevented and the reliability of the testing of the function of the tank ventilation system improved overall. The method can be carried out both when the internal combustion engine is at a standstill and when it is in operation, so testing of the function of the pressure switch can be carried out with great frequency.

According to an embodiment of the method, the measure for increasing the pressure in the tank ventilation system above the pressure limit consists in actuating, when the internal combustion engine is at a standstill, a tank ventilation valve of the tank ventilation system, which valve is arranged in a connecting line between a fuel vapor accumulator of the tank ventilation system and an intake pipe of the internal combustion engine such that the tank ventilation system is pneumatically connected to the intake pipe.

This embodiment of the method allows testing of the function of the pressure switch when the internal combustion engine is at a standstill. The expression "the internal combustion engine is at a standstill" is understood according to the invention to be the state in which the pistons of the internal combustion engine are at rest. After the internal combustion engine has been switched off, ambient pressure establishes itself in the intake pipe of the internal combustion engine. The pneumatic connection of the intake pipe to the tank ventilation system leads to an equalization of pressure and thus to an increase of the pressure in the tank ventilation system above the pressure limit of the pressure switch. The embodiment of the method makes it possible for the pressure inside the tank ventilation system to be increased when the internal combustion engine is at a standstill without the use of additional, electrically operated pressure pumps in the tank ventilation system. The method thus proves to be both cost-effective and reliable.

In an embodiment of the method, the tank ventilation valve is actuated such that the tank ventilation system (3) and the intake pipe (15) are pneumatically separated as soon as the pressure switch switches to the high-pressure position after the measure has been carried out.

In this embodiment of the method, it is ensured that, after the equalization of pressure is complete, the pneumatic connection between the intake pipe and the tank ventilation system is interrupted in order to prevent fuel vapors from flowing into the intake pipe, undergoing combustion when the engine is next started up and thereby adversely affecting the exhaust gas values.

The measure to increase the pressure in the tank ventilation system can, in accordance with an embodiment, consist in actuating the tank ventilation valve of the tank ventilation system when the internal combustion engine is in operation such that the tank ventilation system and the intake pipe are pneumatically separated.

Particularly when the internal combustion engine is operating under partial load, a low pressure establishes itself in the intake pipe due to the throttling effect of a throttle valve in the intake duct of the internal combustion engine, which low pressure is significantly below the pressure limit of the pressure switch. In order therefore to enable testing of the function of the pressure switch even when the internal combustion engine is in operation, the pneumatic separation of the tank ventilation system and the intake pipe prevents the tank ventilation system from being permanently evacuated as a result of pressure equalization with the intake pipe. Only in this way is an increase of pressure in the tank ventilation system above the pressure limit possible as a result of different effects which arise when the internal combustion engine is in operation. These effects will become clear in the embodiments below.

In accordance with embodiments of the method, the acceleration of the vehicle is detected and a defect of the pressure switch is identified when the acceleration exceeds a predefined acceleration limit at least once or several times. The expression "acceleration of the motor vehicle" means both acceleration in and contrary to the direction of travel as well as centrifugal acceleration when traveling along a curve. To detect the centrifugal acceleration, acceleration sensors can be used. The same applies to the acceleration in and contrary to the direction of travel, with the possibility also existing here of calculating the acceleration from the gradients of the change in velocity. This embodiment is based on the recognition that the change of velocity or the acceleration of the motor vehicle produces an intensive movement of the fuel in the fuel supply tank. As a result of the movement of the fuel, the latter tends to exhibit greater outgassing, which in turn leads to an increase of pressure in the tank ventilation system until the pressure limit is exceeded. The acceleration limit must be chosen such that adequate outgassing of the fuel occurs.

According to an embodiment of the method, a temperature is detected which represents a measure of the temperature in the tank ventilation system. A defect of the pressure switch is identified when the temperature exceeds a predefined temperature limit. In further embodiments, the temperature concerned can preferably be the coolant temperature of the internal combustion engine, the temperature in a fuel tank of the motor vehicle, the ambient temperature of the motor vehicle or the exhaust gas temperature of the motor vehicle. The values for these temperatures are generally known through the use of temperature sensors built into the motor vehicle or through temperature models implemented in a control device of the motor vehicle. A change in these temperatures allows an inference to be made as to a temperature change in the tank ventilation system. For example, increasing the ambient temperature of the motor vehicle also increases the temperature in the tank ventilation system. The same applies to increasing the exhaust gas temperature, the tank ventilation system being heated up by the radiation heat in the exhaust gas duct of the motor vehicle. The coolant temperature can be used for this purpose in the same manner.

Increasing the temperature in the tank ventilation system leads to increased outgassing of fuel in the fuel tank and, if the tank ventilation valve is closed, directly to an increase of pressure inside the tank ventilation system above the pressure limit of the pressure switch. These embodiments are based on the recognition that a temperature increase inside the tank ventilation system leads to a natural pressure increase over the pressure limit. This method thus proves to be both cost-effective and reliable.

In a further embodiment of the method, the time period from implementation of the measure to increase the pressure in the tank ventilation system is detected, and a defect of the pressure switch is identified only if the time period exceeds a predefined time limit.

In this embodiment, time delays in the effect of the measure are taken into account. This ensures that the measures which result in a rise of pressure in the tank ventilation system act over a defined minimum time period. This ensures, for example, that adequate time is available for the equalization of pressure between the intake pipe and the tank ventilation system when the tank ventilation valve is open according to an embodiment. The same applies also to the heating of the tank ventilation system according to various embodiments.

Another embodiment of the method relates to the case whereby the measure to increase the pressure in the tank ventilation system consists in switching the tank ventilation valve when the internal combustion engine is at a standstill such that the intake pipe in the internal combustion engine is pneumatically connected to the tank ventilation system. According to this embodiment, testing of the function of the tank ventilation valve is thus carried out before identification of a defect of the pressure switch. The defect of the pressure switch is identified only if this testing of the function reveals that the tank ventilation valve does not clamp in a state in which the tank ventilation system and the intake pipe are pneumatically separated. That is to say, a pressure increase could not arise in the tank ventilation system in this case, and the pressure switch would remain in the low-pressure position. This embodiment therefore further improves the reliability of testing of the function of the pressure switch.

Another embodiment of the method relates to the case where the measure to increase the pressure in the tank ventilation system consists in closing the tank ventilation valve when the internal combustion engine is in operation. Similarly to the embodiment above, here, too, testing of the function of the tank ventilation valve is carried out prior to identification of a defect of the pressure switch. The defect of the pressure switch is identified here only if the testing of the function of the tank ventilation valve reveals that this valve does not clamp in a state in which the tank ventilation system is pneumatically connected to the intake pipe. In this case, a pneumatic separation of the tank ventilation system and the intake pipe would no longer be possible and permanent evacuation of the tank ventilation system would result if the internal combustion engine were in operation. An increase in the pressure as a result of a temperature increase or sharp movement of the fuel in the tank would not be possible. In this respect, this embodiment of the method also increases the reliability of testing of the function of the pressure switch.

A control device according to various embodiments can be embodied such that it can carry out the method steps as described above. With regard to the advantages which emerge from this control device, the reader is referred to the statements made in respect with the different embodiments of the method.

An internal combustion engine according to an embodiment comprises a control device having the features according to various embodiments. Here, too, the reader is referred with regard to the advantages to the statements made in respect to the various methods.

Shown in FIG. 1 is a motor vehicle 1 which has an internal combustion engine 2 and a tank ventilation system 3. The tank ventilation system 3 is connected via a connecting line 4 to the internal combustion engine 2. The motor vehicle 1 also has a temperature sensor 5 for detecting the ambient temperature and an acceleration sensor 6 for detecting the acceleration in and contrary to the direction of travel as well as the centrifugal acceleration of the motor vehicle 1 when traveling along a curve. A control device 7 of the motor vehicle 1 is connected to the internal combustion engine 2, the tank ventilation system 3, the temperature sensor 5 and the acceleration sensor 6 via signal and data lines 8. The control device 7 serves to control the processes running in the internal combustion engine 2 and in the tank ventilation system 3.

Figure 2:
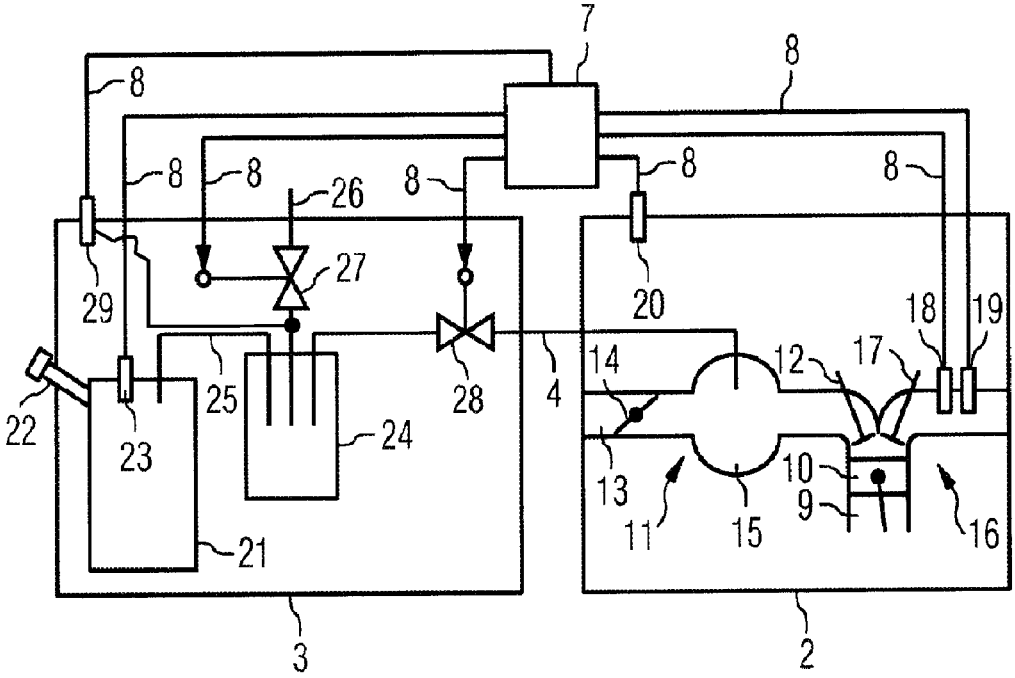
FIG. 2 shows a schematic detailed view of a tank ventilation system and of the internal combustion engine.

FIG. 2 represents schematically the tank ventilation system 3, the internal combustion engine 2 and the control device 7. For reasons of improved clarity, the representation is restricted to the major components.

The internal combustion engine 2 has a cylinder 9 and a piston 10 which can be moved up and down in the cylinder 9. The fresh air necessary for combustion is fed via an intake duct 11 to a combustion chamber defined by the cylinder 9 and the piston 10. The intake duct 11 and the combustion chamber are optionally connected or separated via an inlet valve 12. Downstream of an intake opening 13 of the intake duct 11, at which fresh air is sucked in, is a controllable throttle valve 14 by means of which the air mass flow into the combustion chamber can be adjusted. Downstream of the throttle valve 14 is an intake pipe 15. The combustion gases are emitted via an exhaust gas duct 16. The combustion chamber and the exhaust gas duct 16 are optionally separated or connected via an outlet valve 17. Located in the exhaust gas duct 16 are an exhaust-gas temperature sensor 18 for detecting the exhaust gas temperature and a lambda sensor 19 for detecting the oxygen content in the exhaust gas. The internal combustion engine 2 comprises furthermore a coolant temperature sensor 20 for detecting the temperature of the coolant of the internal combustion engine 2. All the sensors and the throttle valve 14 are connected via signal and data lines 8 to the control device 7.

The tank ventilation system 3 has a fuel reservoir 21 to which fuel can be fed via a filling neck 22. Also provided is a fuel temperature sensor 23 which is connected to the control device 7 and by means of which the temperature inside the fuel reservoir 21 can be detected. The fuel reservoir 21 can be locked by means of a locking cap.

The tank ventilation system 3 comprises furthermore a fuel vapor accumulator 24. This can be, for example, an active carbon filter which can adsorb the fuel vapors up to a specified maximum load. The fuel vapor accumulator 24 is connected via a further connecting line 25 to the fuel reservoir 21, so that the fuel vapors originating there are conveyed to the fuel vapor accumulator 24 and adsorbed there. The fuel vapor accumulator 24 can also be connected via a ventilation line 26 and a controllable ventilation valve 27 arranged therein to the environment. The fuel vapor accumulator 24 can furthermore be pneumatically connected via the connecting line 4 and a controllable ventilation valve 28 arranged therein to the intake pipe 15 of the internal combustion engine 2. When the tank ventilation valve 28 is open, the fuel vapor accumulator 24 is pneumatically connected to the intake pipe 15. When the tank ventilation valve 28 is closed, the fuel vapor accumulator 24 is pneumatically separated from the intake pipe 15. The tank ventilation system has a pressure switch 29 which is in a low-pressure position if the pressure in the tank ventilation system is below a predefined pressure limit and which is otherwise in a high-pressure position. The pressure switch 29, the ventilation valve 27 and the tank ventilation valve 28 are connected to the control device and controllable thereby. The pressure switch 29 may be connected at any location of ventilation system 3 suitable for being switched by the pressure level inside the ventilation system 3, including connection to an internal space of connecting line 4, connecting line 25, fuel vapor accumulator 24, or fuel reservoir. For example, FIG. 2 shows pressure switch 29 connected to ventilation line 26.

An exemplary embodiment of the method according to the invention will be explained in detail below with the aid of the flow diagrams in FIGS. 3 to 6.

Figure 3:
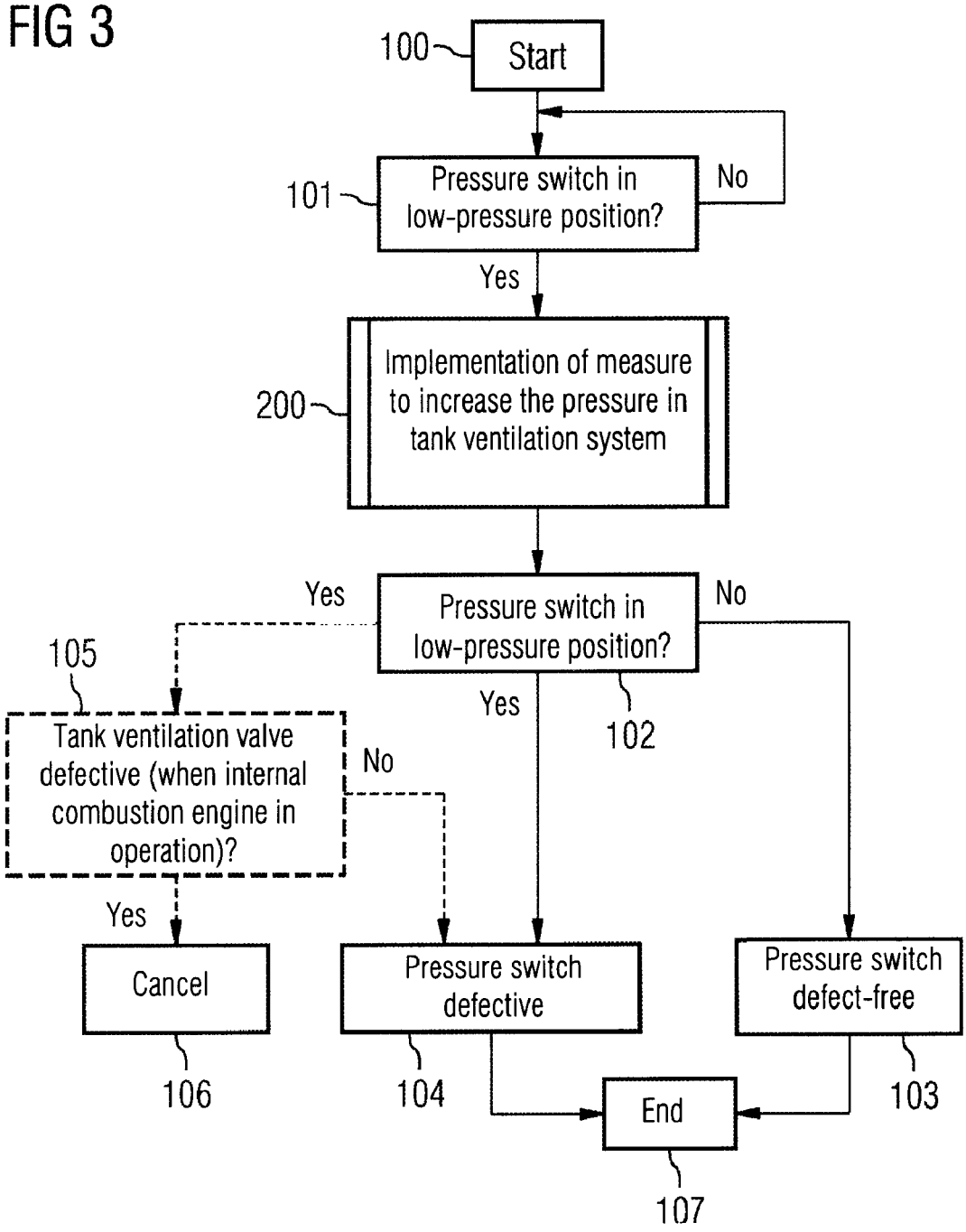
FIGS. 3 to 6 show flow diagrams of an exemplary embodiment of the method.

Shown in FIG. 3 is a flow diagram of the method according to an embodiment in a general form. After the start of the method in step 100, in step 101 the switched state of the pressure switch 29 is detected by the control device 7. A check is made as to whether the pressure switch 29 is in the low-pressure position, which signifies that the pressure in the tank ventilation system 3 lies below the pressure limit. If the pressure switch 29 is in the high-pressure position, step 101 is repeated. If the control device 7 identifies that the pressure switch 29 is in the low-pressure position, the method continues with the sub-method 200 in which a measure to increase the pressure in the tank ventilation system 3 is carried out. A specific exemplary embodiment of the sub-method 200 will be explained in detail below with the aid of FIG. 4.

Figure 4:
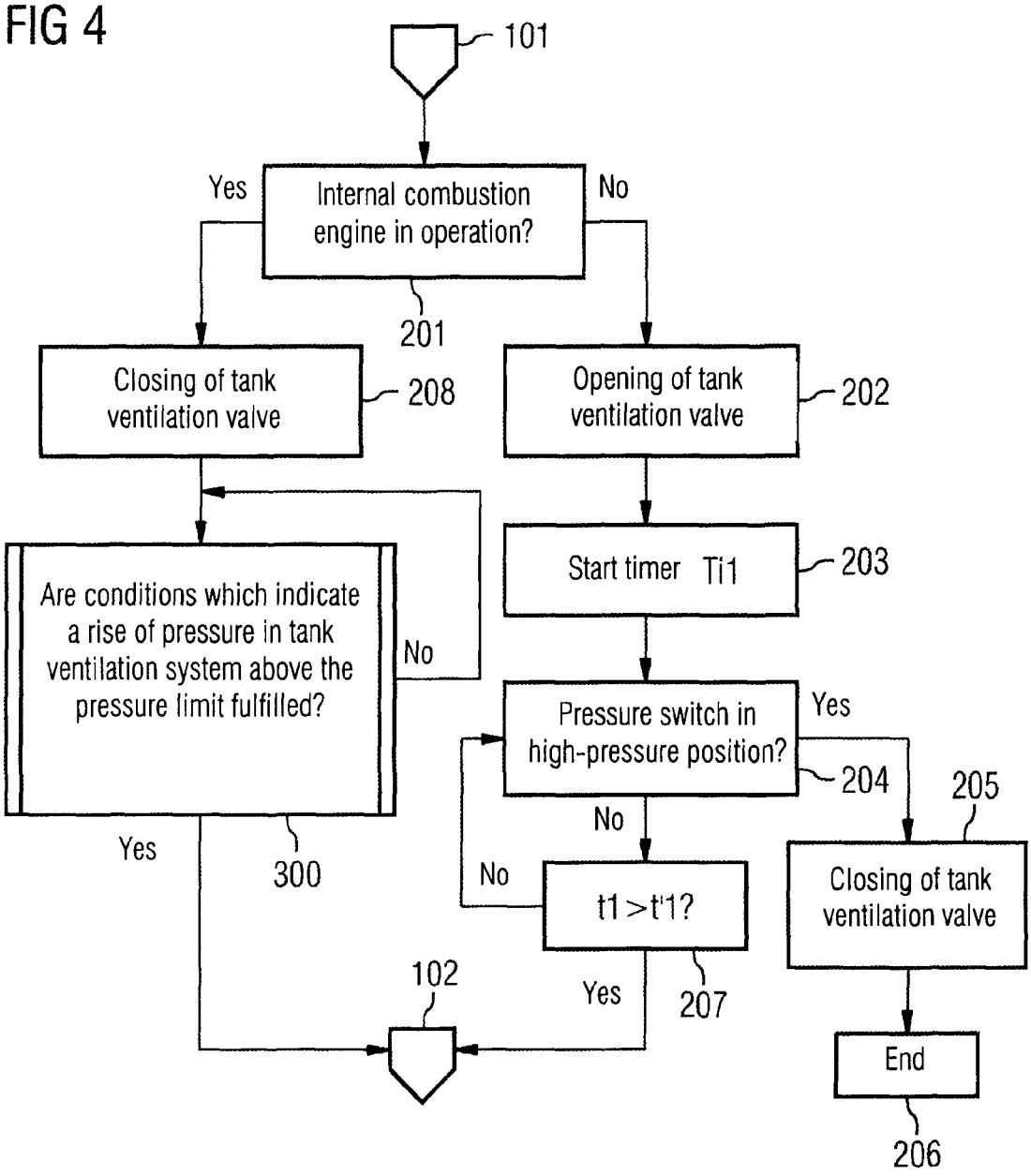

A flow diagram of an exemplary embodiment of the sub-method 200 is shown in FIG. 4. Firstly, in a step 201, the operating state of the internal combustion engine 2 is determined. A check is made as to whether the internal combustion engine 2 is in operation or is at a standstill. The expression "internal combustion engine is in operation" is interpreted as being the state in which the pistons 10 of the internal combustion engine 2 are moving in the cylinder. Combustion does not necessarily have to be taking place. The expression "internal combustion engine is at a standstill" is interpreted as being the state in which the pistons 10 of the internal combustion engine 2 are at rest. This can be carried out, for example, by detecting a rotational speed.

If the control device 7 identifies that the internal combustion engine 2 is at a standstill, the tank ventilation valve 28 is actuated by the control device 7 in step 202 such that the tank ventilation system 3 and the fuel vapor accumulator 24 is pneumatically connected to the intake pipe 15. As a result of the fact that the internal combustion engine is at a standstill, the pressure prevailing in the intake pipe 15 is approximately ambient pressure. By virtue of the pneumatic connection of the tank ventilation system 3 to the intake pipe 15, the pressure is therefore equalized, with ambient pressure also establishing itself in the tank ventilation system 3 after a certain time. In order to cater for this time delay, a timer Ti1 is started in step 203. In step 204, a check is made as to whether the pressure switch 29 is already in the high-pressure position. If this is the case, then in step 205, the tank ventilation valve 28 is closed and the method terminated in step 206 since the tank ventilation valve 28 can in this case be assessed as being defect-free. The pneumatic separation ensures that no fuel vapors flow into the intake pipe, which could adversely influence the exhaust gas values of the internal combustion engine when next started up. Otherwise, the timer Ti1 runs until such time as in step 207 the value t1 of the timer Ti1 exceeds a predefined time limit t1'. The process then continues with step 102 in the flow diagram from FIG. 3.

If it is identified in step 201 that the internal combustion engine 2 is in operation, the tank ventilation valve 28 is actuated by the control device 7 in step 208 such that the tank ventilation system 3 and/or the fuel vapor accumulator 24 and the intake pipe 15 of the internal combustion engine 2 are pneumatically separated. When the internal combustion engine 2 is in operation, a low pressure arises in the intake pipe 15, at least in the partial-load range, as a result of the throttling effect at the throttle valve 14. As a result of the fact that the tank ventilation system 3 is pneumatically separated from the intake pipe 15 by the tank ventilation valve 28 being closed, a permanent evacuation of the tank ventilation system 3 is prevented. This is a requirement for increasing the pressure inside the tank ventilation system 3 and testing the function of the pressure switch 29 when the internal combustion engine 2 is in operation. The process is then continued with sub-method 300 in which a check is made as to whether the conditions have been fulfilled that are indicative of a rise in pressure in the tank ventilation system 3 above the pressure limit.

Figure 5:
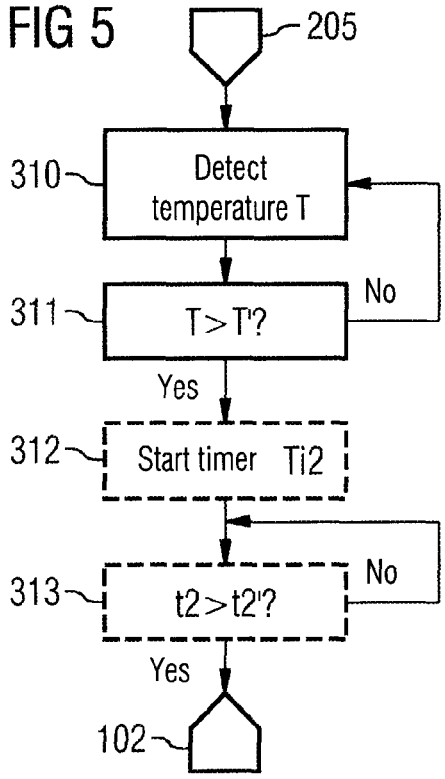
Figure 6:
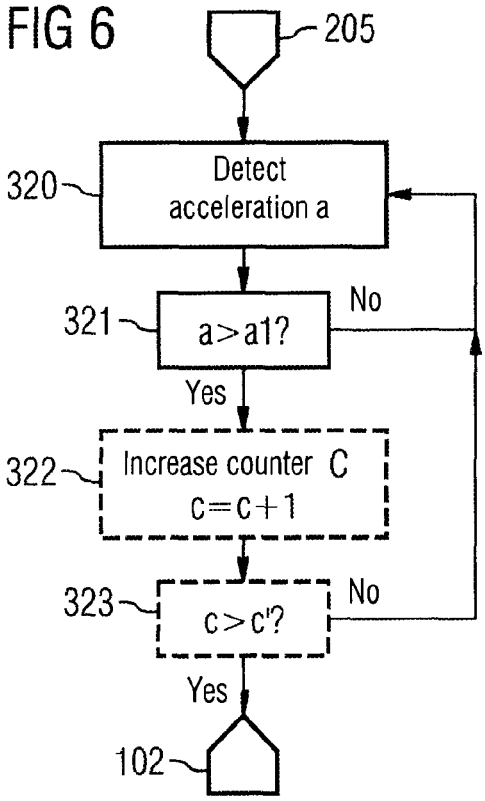

Embodiments of the sub-method 300 are represented in FIGS. 5 and 6.

In a first embodiment of the sub-method 300 according to FIG. 5, in a step 310 a temperature T is detected which can be used as a measure of the temperature inside the tank ventilation system 3. This can be, for example, measured values of the temperature sensor 5, the exhaust-gas temperature sensor 18, the coolant temperature sensor 20 or the fuel temperature sensor 23. These temperature values are suitable as a measure for estimating the temperature in the tank ventilation system 3 since these temperatures have a direct effect on the temperature in the tank ventilation system 3. For example, it can be assumed that the temperature inside the tank ventilation system 3 will, even at a low engine loading, lie not substantially below the ambient temperature. It can be assumed furthermore that at very high exhaust gas temperatures and/or engine coolant temperatures, the thermal energy radiated by the exhaust gas line of the motor vehicle 1 onto the tank ventilation system 3 will lead to a heating of the tank ventilation system 3. The value of the fuel temperature can be estimated most accurately, since it is measured directly inside the tank ventilation system 3.

After the temperature T has been detected, a check is made in step 311 as to whether the detected temperature T is greater than a predefined temperature limit T'. If this is not the case, this query is repeated in step 310. If the detected temperature T is greater than the predefined limit T', the sub-method is not continued until a certain time period has lapsed. To this end, in steps 312 and 313 a timer Ti2 is started and the method is only continued when the value t2 of the timer Ti2 is greater than a predefined time limit t2'. Delaying the method for the time period t2' allows for the time delay of the temperature increase inside the tank ventilation system 3 in relation to the detected temperature T. For example, the heating up of the tank ventilation system 3 by the radiation heat radiated by the exhaust gas line takes place with a delay. The same is true of an increase in the ambient temperature. It should, however, be noted that steps 312 and 313 are only optional, which is denoted in FIG. 5 by the dashed border. After the time limit t2' has been exceeded, step 102 of the method is continued as shown in FIG. 3.

A further embodiment of the sub-method 300 is represented in FIG. 6. According to this embodiment, in step 320 an acceleration a of the motor vehicle 1 is detected. This can be determined on the one hand by the acceleration sensor 6 provided in the motor vehicle 1 or through electronic determination of the gradient of the change in velocity of the motor vehicle 1 by means of the control device 7. It should be noted here that not only can the acceleration of the motor vehicle 1 in and contrary to the direction of travel be used, but also centrifugal accelerations when traveling along a curve. In a step 321 a check is made as to whether the acceleration a exceeds a predefined acceleration limit a1. If this is not the case, the value for the acceleration a is detected again. In the case where the acceleration a is greater than the acceleration limit a1, in a step 322 the value c of the counter C can be incremented by 1. In step 323, a query can be made as to whether the value c of the counter C is greater than a predefined counter limit c'. If this is not the case, the acceleration a is detected again in step 320. The process is otherwise continued with step 102 of the method as shown in FIG. 3.

High accelerations of the vehicle lead to sharp movements of the fuel in the fuel reservoir 21 of the tank ventilation system 3. The movement of the fuel gives rise to increased outgassing of the fuel, which in turn leads to a pressure increase in the tank ventilation system 3. However, appreciable outgassing effects occur only upward of a certain minimum acceleration, which is why in step 321 an appropriate query is carried out. The provision of a counter in accordance with steps 322 and 323 takes account of the fact that an appreciable increase of the pressure in the tank ventilation system 3 occurs only when the acceleration limit a1 has been exceeded several times. It should be noted that steps 322 and 323 are optional, which is denoted by the dashed border around these steps in FIG. 6.

It is pointed out that the embodiments of the sub-method 300 according to FIGS. 5 and 6 can also be combined with one another, i.e. that both a temperature detection and a detection of the acceleration a can be effected in parallel with one another, and the main method continued with step 102 either upon fulfillment of one of the two criteria or upon fulfillment of both criteria. However, this case is not shown.

After sub-method 300 has been carried out according to the embodiments shown in FIGS. 5 and 6, the process is continued with step 102 of the method as shown in FIG. 3.

A check is made in step 102 as to what switched state the pressure switch 29 is in after the measure to increase the pressure in the tank ventilation system 3 has been carried out. If it is identified that the pressure switch 29 is not in the low-pressure position but is in the high-pressure position, then pressure switch 29 is assessed as being defect-free according to step 103. This conclusion is useful since the switching of the pressure switch 29 from the low-pressure position to the high-pressure position on the basis of the measure to increase the pressure in the tank ventilation system 3 suggests a pressure switch 29 that is functioning in a defect-free manner.

If, on the other hand, it is established in step 102 that the pressure switch 29 is in the low-pressure position even after the measure to increase the pressure in the tank ventilation system 3 has been carried out, a defect of the pressure switch 29 can be identified according to step 104.

If the measure to increase the pressure in the tank ventilation system 3 was carried out when the internal combustion engine 2 was in operation, i.e. according to method steps 108 and 300 in FIG. 4, testing of the tank ventilation valve 28 can optionally be carried out prior to identification of a defect of the pressure switch 29 in step 105. This is possible, for example, by actuating the tank ventilation valve 28 when the internal combustion engine 2 is in operation such that the fuel vapor accumulator 24 is pneumatically connected to the intake pipe 15 of the internal combustion engine 2 (see FIG. 2). Furthermore, the ventilation valve 27 must also be actuated such that the fuel vapor accumulator 24 is pneumatically connected to the environment, and fresh air can enter the fuel vapor accumulator 24. In the case of a fuel vapor accumulator 24 loaded with fuel vapors, a rinsing effect is achieved in this way, which means that fuel vapors adsorbed in the active carbon filter are sucked in by the low pressure prevailing in the intake pipe 15 and at the same time fresh air enters the fuel vapor accumulator 24 via the ventilation valve 27. The fuel vapors fed to the intake pipe 15 are fed via the inlet valve 12 to the combustion chamber of the internal combustion engine 2 and undergo combustion. This altered composition of the combustible mixture also makes itself noticeable in the exhaust gas composition and is detected by the lambda sensor 19. If such a change is identified by the control device 7 after the tank ventilation valve 28 has been actuated, clamping of the tank ventilation valve 28 in a state in which the tank ventilation system 3 and the intake pipe 15 are pneumatically separated can be ruled out. If no change is established in the exhaust gas composition even after actuation of the tank ventilation valve 28, it can be concluded that the tank ventilation valve 28 is defective. In this case, the testing of the function of the pressure switch 29 in step 105 must be aborted, since it cannot usefully be carried out when the tank ventilation valve 28 is defective. If, on the other hand, the tank ventilation valve 28 is identified as functioning correctly, it is concluded in step 106 that the pressure switch 29 is defective.

The method described above enables reliable testing of the function of the pressure switch 29 of the tank ventilation system 3 both when the internal combustion engine 2 is in operation and when it is at a standstill. The frequency of diagnosis for the pressure switch 29 can in this way be carried out very flexibly and frequently.

LIST OF REFERENCE CHARACTERS

1 motor vehicle
2 internal combustion engine
3 tank ventilation system
4 connecting line
5 temperature sensor
6 acceleration sensor
7 control device
8 signal and data line
9 cylinder
10 piston
11 intake duct
12 inlet valve
13 intake opening
14 throttle valve
15 intake pipe
16 exhaust gas duct
17 outlet valve
18 exhaust-gas temperature sensor
19 lambda sensor
20 coolant temperature sensor
21 fuel reservoir
22 filling neck
23 fuel temperature sensor
24 fuel vapor accumulator
25 further connecting line
26 ventilation line
27 ventilation valve
28 tank ventilation valve
29 pressure switch

The invention claimed is:

1. A method for testing the function of a pressure switch of a tank ventilation system for an internal combustion engine of a motor vehicle, the pressure switch being in a low-pressure position if the pressure in the tank ventilation system is lower than a predefined pressure limit, and the pressure switch being in a high-pressure position if that is not the case, wherein the method comprises the following steps:

detecting a switched state of the pressure switch, carrying out a measure that increases the pressure in the tank ventilation system above the pressure limit if the pressure switch is in the low-pressure position, the measure including:

actuating a tank ventilation valve arranged in a connecting line between a fuel vapor accumulator and an intake pipe of the internal combustion engine when the internal combustion engine is in operation such that the tank ventilation system and the intake pipe are pneumatically separated; and determining whether conditions indicate a sufficient rise of pressure in the tank ventilation system for testing the function of the pressure switch, including at least one of:

determining whether a detected acceleration of the motor vehicle exceeds a predefined acceleration limit; and determining whether a detected temperature of the motor vehicle exceeds a predefined temperature limit; and identifying a defect of the pressure switch if the pressure switch remains in the low-pressure position after the measure has been carried out.

2. The method according to claim 1, wherein the measure comprises: when the internal combustion engine is at a standstill, a tank ventilation valve of the tank ventilation system, which valve is arranged in a connecting line between a fuel vapor accumulator and an intake pipe of the internal combustion engine, is actuated such that the tank ventilation system is pneumatically connected to the intake pipe.

3. The method according to claim 2, wherein the tank ventilation valve is actuated such that the tank ventilation system and the intake pipe are pneumatically separated once the pressure switch switches to the high-pressure position after the measure has been carried out.

4. The method according to claim 1, wherein the defect of the pressure switch is identified only when the acceleration exceeds the predefined acceleration limit several times.

5. The method according to claim 1, wherein both the longitudinal acceleration and the lateral acceleration of the motor vehicle are detected.

6. The method according to claim 1, wherein the temperature concerned is the coolant temperature of the internal combustion engine.

7. The method according to claim 1, wherein the temperature concerned is the temperature in a fuel tank of the motor vehicle.

8. The method according to claim 1, wherein the temperature concerned is the ambient temperature of the motor vehicle.

9. The method according to claim 1, wherein the temperature concerned is the exhaust gas temperature of the motor vehicle.

10. The method according to claim 2, wherein the time period from implementation of the measure is detected, and a defect of the pressure switch is identified, only when the time period exceeds a predefined time-period limit.

11. The method according to claim 2, wherein prior to identification of a defect of the pressure switch, testing of the function of the tank ventilation valve is carried out and the defect of the pressure switch is identified only when the testing of the function of the tank ventilation valve reveals that the tank ventilation valve does not clamp in a state in which the tank ventilation system is pneumatically separated from the intake pipe.

12. The method according to claim 1, wherein prior to identification of a defect of the pressure switch, testing of the function of the tank ventilation valve is carried out and the defect of the pressure switch is identified only when the testing of the function of the tank ventilation valve reveals that the tank ventilation valve does not clamp in a state in which the tank ventilation system is pneumatically connected to the intake pipe.

13. A control device for a motor vehicle which comprises a tank ventilation system, the tank ventilation system having a pressure switch that is in a low-pressure position if the pressure in the tank ventilation system is lower than a predefined pressure limit, and the pressure switch being in a high-pressure position if that is not the case, wherein the control device for testing the function of the pressure switch is operable:

to detect a switched state of the pressure switch, to carry out a measure that increases the pressure in the tank ventilation system above the pressure limit if the pressure switch is in the low-pressure position, the measure including:

actuating a tank ventilation valve arranged in a connecting line between a fuel vapor accumulator and an intake pipe of the internal combustion engine when the internal combustion engine is in operation such that the tank ventilation system and the intake pipe are pneumatically separated; and determining whether conditions indicate a sufficient rise of pressure in the tank ventilation system for testing the function of the pressure switch, including at least one of:

determining whether a detected acceleration of the motor vehicle exceeds a predefined acceleration limit; and determining whether a detected temperature of the motor vehicle exceeds a predefined temperature limit; and to identify a defect of the pressure switch if the pressure switch remains in the low-pressure position after the measure has been carried out.

14. The control device according to claim 13, wherein the measure comprises: when an internal combustion engine of the motor vehicle is at a standstill, a tank ventilation valve of the tank ventilation system, which valve is arranged in a connecting line between a fuel vapor accumulator and an intake pipe of the internal combustion engine, is actuated such that the tank ventilation system is pneumatically connected to the intake pipe.

15. The control device according to claim 13, wherein the defect of the pressure switch is identified only when the acceleration exceeds the predefined acceleration limit several times.

16. The control device according to claim 13, wherein both the longitudinal acceleration and the lateral acceleration of the motor vehicle are detected.

17. The control device according to claim 13, wherein the temperature concerned is the coolant temperature of the internal combustion engine.

18. The control device according to claim 13, wherein the temperature concerned is the temperature in a fuel tank of the motor vehicle.

19. The control device according to claim 13, wherein the temperature concerned is the ambient temperature of the motor vehicle.

20. The control device according to claim 13, wherein the temperature concerned is the exhaust gas temperature of the motor vehicle.

21. The control device according to claim 14, wherein the time period from implementation of the measure is detected, and a defect of the pressure switch is identified only when the time period exceeds a predefined time-period limit.

22. The control device according to claim 14, wherein prior to identification of a defect of the pressure switch, testing of the function of the tank ventilation valve is carried out, and the defect of the pressure switch is identified, only if the testing of the function of the tank ventilation valve reveals that the tank ventilation valve does not clamp in a state in which the tank ventilation system is pneumatically separated from the intake pipe.

23. The control device according to claim 13, wherein prior to identification of a defect of the pressure switch, testing of the function of the tank ventilation valve is carried out, and the defect of the pressure switch is identified, only if the testing of the function of the tank ventilation valve reveals that the tank ventilation valve does not clamp in a state in which the tank ventilation system is pneumatically connected to the intake pipe.

24. An internal combustion engine for a motor vehicle which comprises a tank ventilation system, the tank ventilation system having a pressure switch that is in a low-pressure position if the pressure in the tank ventilation system is lower than a predefined pressure limit, and the pressure switch being in a high-pressure position if that is not the case, the internal combustion engine comprising:

a control device for testing the function of the pressure switch, the control device operable:

to detect a switched state of the pressure switch, to carry out a measure that increases the pressure in the tank ventilation system above the pressure limit if the pressure switch is in the low-pressure position, the measure including:

actuating a tank ventilation valve arranged in a connecting line between a fuel vapor accumulator and an intake pipe of the internal combustion engine when the internal combustion engine is in operation such that the tank ventilation system and the intake pipe are pneumatically separated; and determining whether conditions indicate a sufficient rise of pressure in the tank ventilation system for testing the function of the pressure switch, including at least one of:

determining whether a detected acceleration of the motor vehicle exceeds a predefined acceleration limit; and determining whether a detected temperature of the motor vehicle exceeds a predefined temperature limit; and to identify a defect of the pressure switch if the pressure switch remains in the low-pressure position after the measure has been carried out.

* * * * *